United States Patent [19]

Ninomiya et al.

[11] Patent Number: 4,719,698

[45] Date of Patent: Jan. 19, 1988

[54] ELECTRIC SHAVER WITH A DRIVE CONTROL

[75] Inventors: Kazunori Ninomiya; Katuaki Shitama, both of Nougata; Masashi Aoi, Fukuoka, all of Japan

[73] Assignee: Kyushu Hitachi Maxell, Ltd., Fukuoka, Japan

[21] Appl. No.: 881,335

[22] Filed: Jul. 2, 1986

[30] Foreign Application Priority Data

| | | | |
|---|---|---|---|
| Jul. 2, 1985 | [JP] | Japan | 60-100682[U] |
| Jul. 20, 1985 | [JP] | Japan | 60-111729[U] |
| Jul. 20, 1985 | [JP] | Japan | 60-111730[U] |
| Oct. 17, 1985 | [JP] | Japan | 60-159417[U] |

[51] Int. Cl.[4] ..... B26B 19/14

[52] U.S. Cl. ..... 30/43.6; 30/43.92; 318/345 E; 322/26

[58] Field of Search ..... 30/43.1, 43.4, 43.5, 30/43.6, 43.7–43.92, 45; 83/72, 74; 322/31, 26, DIG. 4; 318/345 R, 345 E

[56] References Cited

U.S. PATENT DOCUMENTS

| | | | |
|---|---|---|---|
| 2,731,592 | 1/1956 | Federn | 322/26 |
| 2,748,341 | 5/1956 | Federn | 322/26 |
| 3,343,056 | 9/1967 | Hirschmann | 30/43.1 X |
| 4,233,733 | 11/1980 | Gallanis et al. | 30/43.92 |
| 4,611,153 | 9/1986 | Wesling | 318/345 E |

*Primary Examiner*—Douglas D. Watts

*Attorney, Agent, or Firm*—Birch, Stewart, Kolasch & Birch

[57] ABSTRACT

An electric shaver comprising a shaver housing comprising a generally rectangular box-like casing and a head casing removably mounted on one end of the box-like casing; a finely perforated stationary shear foil replaceably mounted on the head casing; a reciprocable blade assembly positioned inside the head casing and outside the box-like casing and cooperable with the stationary shear foil to cut bristles entering the head casing through the perforations in the stationary shear foil; an electric drive motor accommodated within the box-like casing and having a drive shaft, said drive shaft having first and second ends opposite to each other and protruding outwards from the motor in opposite directions away from each other; means for connecting the first end of the drive shaft with the blade assembly to permit the blade assembly to undergo oscillation relative to the stationary shear foil; a photoelectric detector comprising a light emitting element and a photoelectric cell for providing an electric output signal indicative of a parameter descriptive of the speed of rotation of the motor; and at least one printed circuit board incorporating a control circuit for controlling the motor in dependence on the output signal and accommodated within the box-like casing.

7 Claims, 21 Drawing Figures

ELECTRIC SHAVER WITH A DRIVE CONTROL

BACKGROUND OF THE INVENTION

The present invention generally relates to an electric shaver and, more particularly, to an electric shaver incorporating a drive control for controlling the speed of rotation of a drive motor to an optimum value.

It is well known that, when an electric shaver is actually used for shaving beard, the optimum shaving is achieved if an electric motor used in the electric shaver is driven at about 6,600 rpm. This is illustrated in the graph shown in FIG. 1 of the accompanying drawings, which shows the relationship between the speed of rotation of the motor used in the electric shaver and the percentage of the number of beard bristles so cut as to represent a good cross-sectional contour relative to the total number of beard bristles having been shaved. The graph of FIG. 1 accounts that a higher or lower speed of rotation of the motor in the electric shaver than about 6,600 rpm would not ensure the optimum shaving performance. In practice, the actual speed of rotation of the drive motor effective to achieve the optimum shaving performance varies from 6,600 to 8,000 rpm depending on the type of a particular electric shaver.

In view of the foregoing, an electric shaver incorporating a drive control for controlling the motor at all times to a predetermined speed required to achieve the optimum shaving performance regardless of the magnitude of a load imposed on the motor has been proposed in, for example, Japanese Laid-open Patent Publication No. 61-62381, published Mar. 31, 1986, the invention of which has been assigned to the same assignee of the present invention. This prior art drive control is reproduced in FIG. 1 of the accompanying drawings and comprises a speed detector for detecting, and generating a speed signal indicative of, the speed of rotation of the motor, a digital-to-analog converter for converting the speed signal into an analog speed signal, a comparator for comparing the analog speed signal with a reference signal representative of the predetermined speed of rotation and for generating a difference signal indicative of the difference in level between the analog speed signal and the reference signal, and a control circuit for controlling the amount of voltage to be supplied to the motor in dependence on the difference signal thereby to control the speed of rotation of the motor to the predetermined value. The drive control is also shown as including a load detector for detecting a reduction in speed of rotation of the motor resulting from an excessive load imposed thereon and for increasing the voltage being applied to the motor in the event of the reduction of the motor speed below a predetermined value, and a display providing a visual indication of the occurrence of the reduction of the motor speed.

The above mentioned publication also discloses a specific wiring circuit of the drive control. Furthermore, the speed detector disclosed therein comprises a pick-up coil and an operational amplifier, said pick-up coil being disposed in the vicinity of the motor for detecting a change of the magnetic field generated by the motor during the rotation of the motor. The use of a light emitting element and a photoelectric sensor in combination with an interceptor for intercepting the path of travel between the light emitting element and the photoelectric sensor as a function of the motor speed is also suggested in the above mentioned publication as an alternative form of the speed detector.

However, the above mentioned publication is silent as to a specific arrangement and positioning of the photoelectric detector in relation to mechanical component parts of the electric shaver. As is well known to those skilled in the art, clippings of hair or beard gather in the vicinity of and around a reciprocable blade assembly cooperating with a stationary finely perforated shear foil. Moreover, not only may it not infrequently happen that the electric shaver receive shocks such as when slipped onto the floor or a sink, but also the electric shaver itself is subjected to vibrations. Therefore, care is required in selecting the arrangement and position of the photoelectric detector in consideration of the clippings and/or the vibrations.

SUMMARY OF THE INVENTION

The present invention has for its essential object to provide an improved electric shaver wherein specific arrangement and positioning have been made to enable the photoelectric detector to provide a reliable output signal indicative of a parameter descriptive of the speed of rotation of the motor, without being adversely affected by clippings of bristles and also by vibrations induced in the shaver.

In order to achieve this object, the present invention provides an electric shaver comprising a shaver housing comprising a generally rectangular box-like casing and a head casing removably mounted on one end of the box-like casing; a finely perforated stationary shear foil replaceably mounted on the head casing; a reciprocable blade assembly positioning inside the head and casing and outside the box-like casing and cooperable with the stationary shear foil to cut bristles entering the head casing through the perforations in the stationary shear foil; an electric drive motor accommodated within the box-like casing and having a drive shaft, said drive shaft having first and second ends opposite to each other and protruding outwards from the motor in opposite directions away from each other; means for connecting the first end of the drive shaft with the blade assembly to permit the blade assembly to undergo oscillation relative to the stationary shear foil; a photoelectric detector comprising a light emitting element and a photoelectric cell for providing an electric output signal indicative of a parameter descriptive of the speed of rotation of the motor; and at least one printed circuit board incorporating a control circuit for controlling the motor in dependence on the output signal and accommodated within the box-like casing.

In one preferred embodiment, the photoelectric detector cooperates with a generally cylindrical photointerrupter element rigidly mounted on the second end of the drive shaft for rotation together therewith, said photointerrupter element having at least one reflective surface area and at least one non-reflective surface are both formed on the outer peripheral surface of the photointerrupter element in a direction circumferentially thereof. This photoelectric detector is rigidly mounted on said circuit board at a location aligned with the photointerrupter element such that rays of light emitted by the light emitting element can be reflected from the reflective surface area of the photointerrupter element back towards the photoelectric cell during the rotation of the motor.

In another preferred embodiment, the photoelectric detector is positioned so as to detect the oscillation of an oscillatory support forming a part of the connecting means and supporting the blade assembly. For this purpose, the light emitting element and the photoelectric cell are positioned on respective sides of one of resilient arms of the oscillatory support.

BRIEF DESCRIPTION OF THE DRAWINGS

This and other objects and features of the present invention will become clear from the following description taken in conjunction with preferred embodiments thereof with reference to the accompanying drawings, in which.

DETAILED DESCRIPTION OF THE EMBODIMENTS

Figure 2:
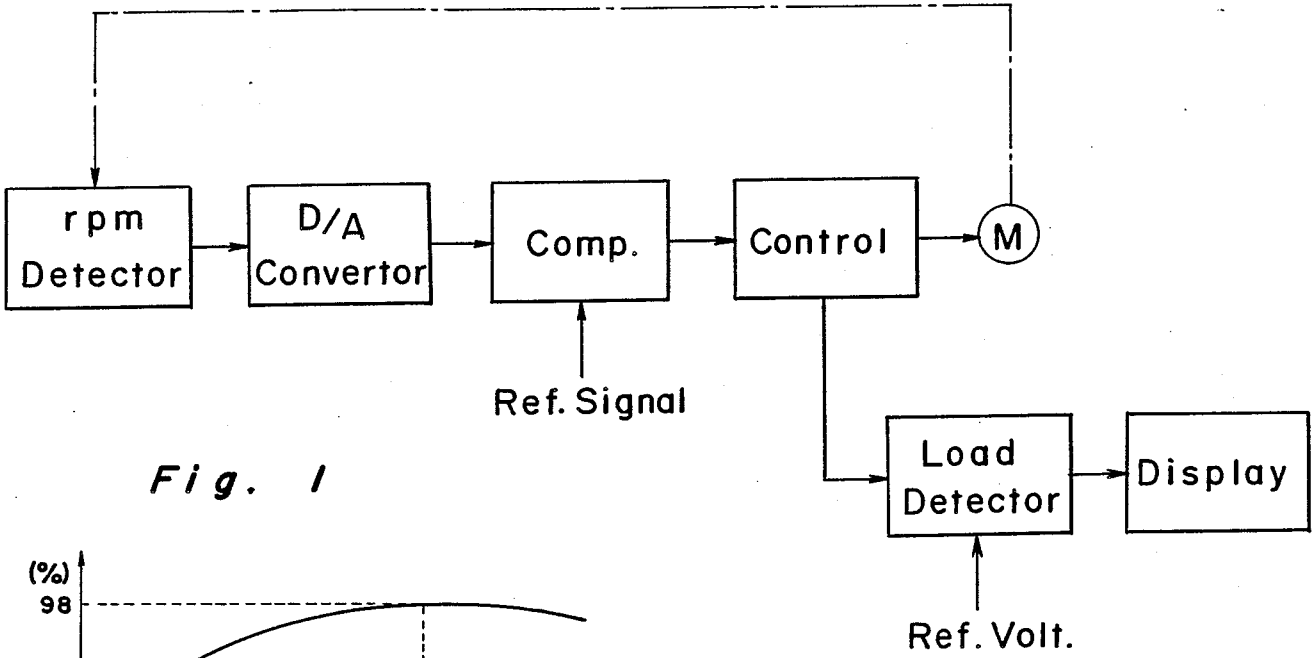
Fig. 2 Prior Art
FIG. 2 is a circuit block diagram showing the prior art control system for controlling the motor to a predetermined speed.
Figure 1:
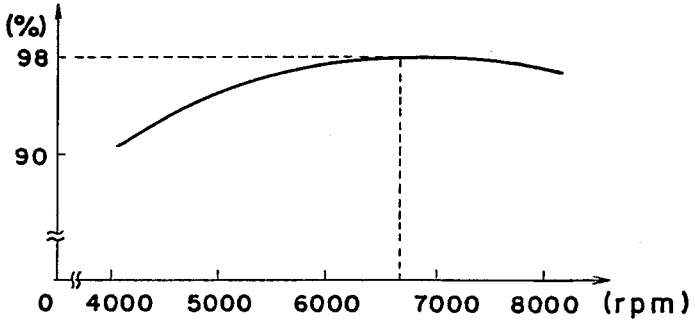
FIG. 1 illustrates a graph showing the shaving performance in relation to the speed of rotation of an electric motor used in electric shavers.
Figure 3:
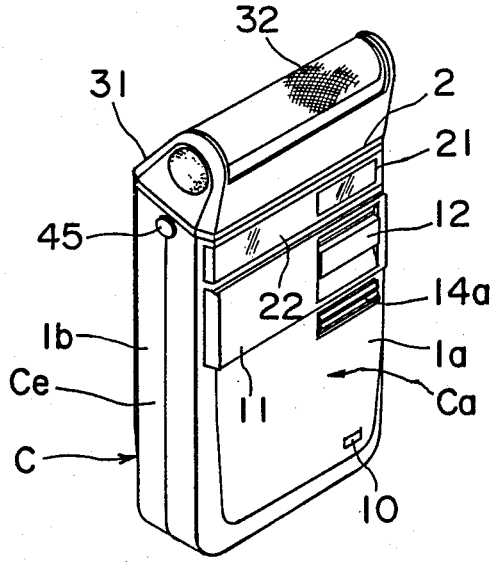
FIGS. 3 and 4 are perspective views of an electric shaver embodying the present invention as viewed from different angles, respectively.
Figure 4:
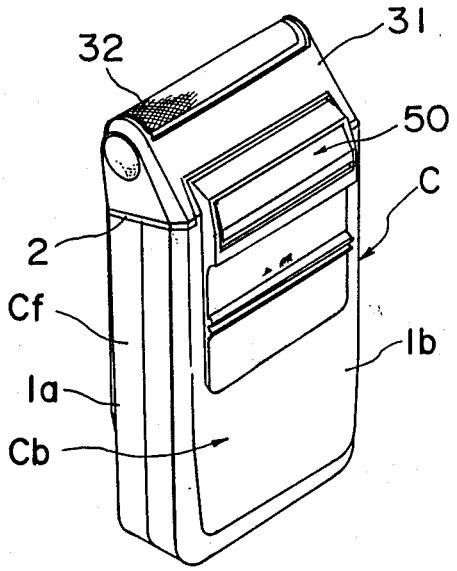

Before the description of the present invention proceeds, it is to be noted that like parts are designated by like reference numerals throughout the drawings.

Figure 5:
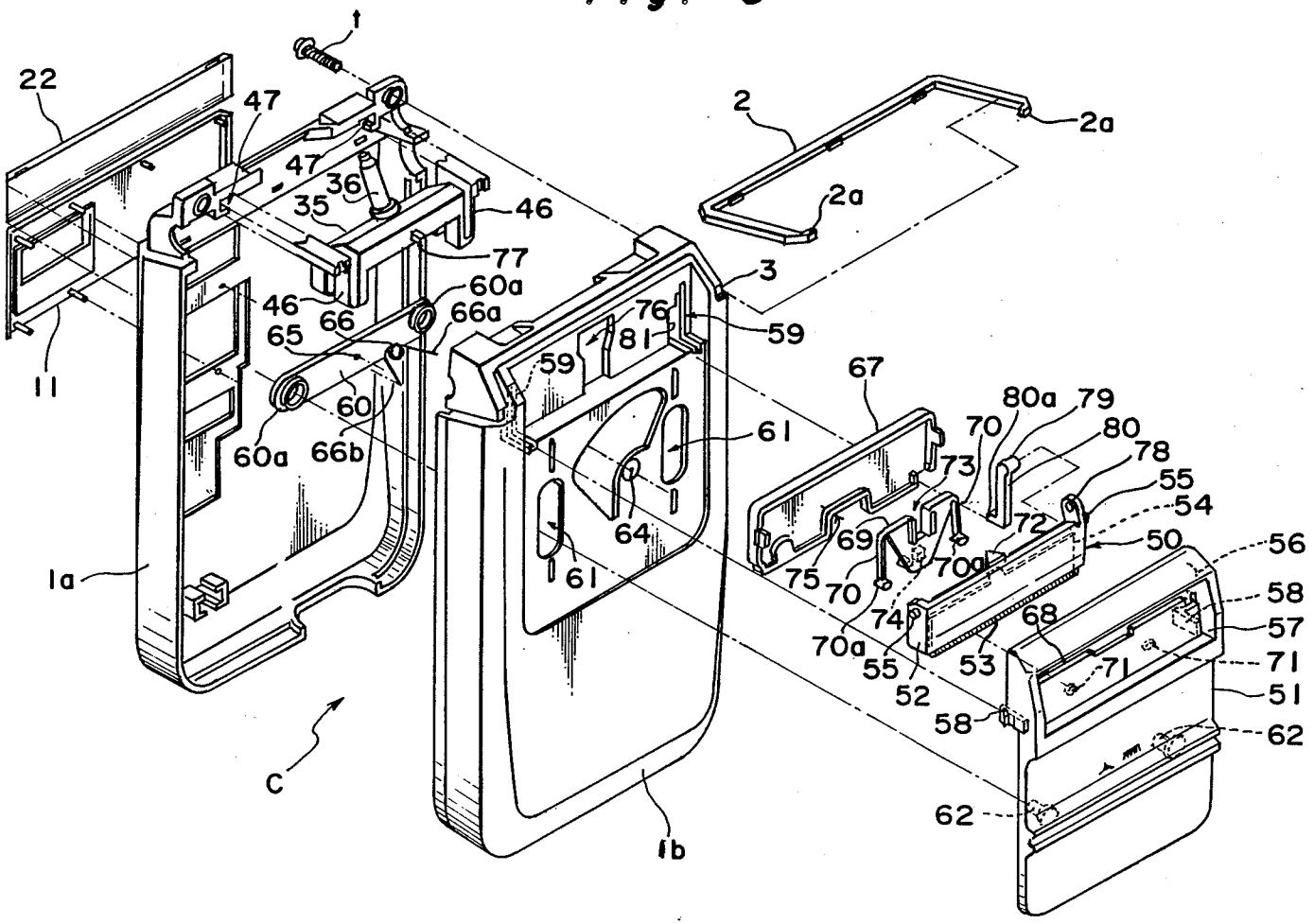
FIG. 5 is an exploded view of the electric shaver with the motor and printed circuit boards omitted.

Referring first to FIGS. 1 to 14, an electric shaver according to one embodiment of the present invention shown therein comprises a casing C having front and rear walls Ca and Cb, top and bottom walls Cc and Cd, and a pair of opposite side walls Ce and Cf. In practice, the casing C is, as best shown in FIG. 5, comprised of generally rectangular, U-sectioned front and rear casing halves 1*a* and 1*b* combined together so as to render the casing C as a whole to represent a generally rectangular box-like configuration. More specifically, the casing C is assembled by combining the front and rear casing halves 1*a* and 1*b* together with their peripheral flanges held in abutment with each other, then mounting a generally U-shaped elastic molding 2 from exterior of the front casing half 1*a* until the opposite pawl-shaped ends 2*a* of the molding 2 are snapped into respective detent recesses defined at 3 in the rear casing half 1b to permit the front and rear casing halves 1*a* and 1*b* to be temporarily embraced together, and finally threading a plurality of, for example, two, set screws t into the rear casing half 1*b* after having passed through the front casing half 1*a*.

It is to be noted that the terms "top", "bottom", "front" and "rear" and any other similar terms descriptive of the position used in the specification refer to the position of the electric shaver during the actual use, the front casing half 1*a* or the front wall Ca being the one confronting the face of the user of the electric shaver.

The front wall Ca of the casing C has a decorative panel 11 staked, or otherwise bonded exteriorly thereto so as to extend widthwise of the casing C. A portion of the decorative panel 11 adjacent the side wall Cf of the casing C is provided with a switch knob 12 having an actuator rod 12*a* which extends through the panel 11 and the front wall Ca and terminates in engagement with an actuator 13*a* of a push-on, push-off switch 13 as will be described later. By the action of a spring element (not shown) built in the switch 13 for urging the actuator 13*a* so as to assume a projected position, the switch knob 12 is normally held in an OFF position, but can be depressed to an ON position, when an external pushing force is applied thereto, to turn the switch 13 on. The return of the switch knob 12 to the OFF position can be accomplished by applying the external pushing force again thereto.

In order to prevent the switch 13 from being inadvertently turned on when and so long as the electric shaver is not in use, that is, in order to lock the switch knob 12 in the OFF position, a generally rectangular lock plate is fitted to a portion of the interior surface of the front wall Ca immediately below the switch knob 12 for sliding movement between released and locked positions in a direction close towards and away from the switch knob 12. This lock plate 14 has a lock knob 14*a* exposed to the outside of the casing C through a rectangular opening defined in the front wall Ca for the access to a finger of the user so that, by manipulating the lock knob 14*a*, the lock plate 14 can be slid between the released and locked positions depending on the direction in which the lock knob 14*a* is manually moved. The lock plate 14 also has a pair of fingers 14*b*, which only when the lock plate 14 is slid to the locked position project into the path of movement of the switch knob 12 to disable the depression of the switch knob 12 to the ON position and, thus, to lock the switch knob 12 in the OFF position, and a pair of resilient legs 14*c* extending outwardly therefrom in a direction opposite to the fingers 14*b*. The resilient legs 14*c* are spaced a distance from each other and are cooperable with a detent pin 15 formed with the front wall Ca so as to extend therefrom into a space between the resilient legs 14*c*. The legs 14*c* are resiliently engaged to the detent pin 15 from opposite directions to prevent the lock plate 14 from undergoing any abitrary motion. In any event, the legs 14c and the detent pin 15 altogether constitute a detent mechanism by which the lock plate 14 can be selectively moved and held at one of the released and locked positions.

The front wall Ca of the casing C has a display opening defined immediately above the switch knob 12, which display opening is covered by an elongated transparent, or semi-transparent, plate 22 affixed to the front wall Ca above the decorative panel 11 so as to extend widthwise of the casing C. Another display opening is also formed in the front wall Ca beneath the lock knob 14a and adjacent the bottom wall Cd of the casing, into which a colored plastics piece 10 (FIG. 3) is embedded and fixed in position in any suitable manner. The function of these display openings will be described later.

Figure 10:
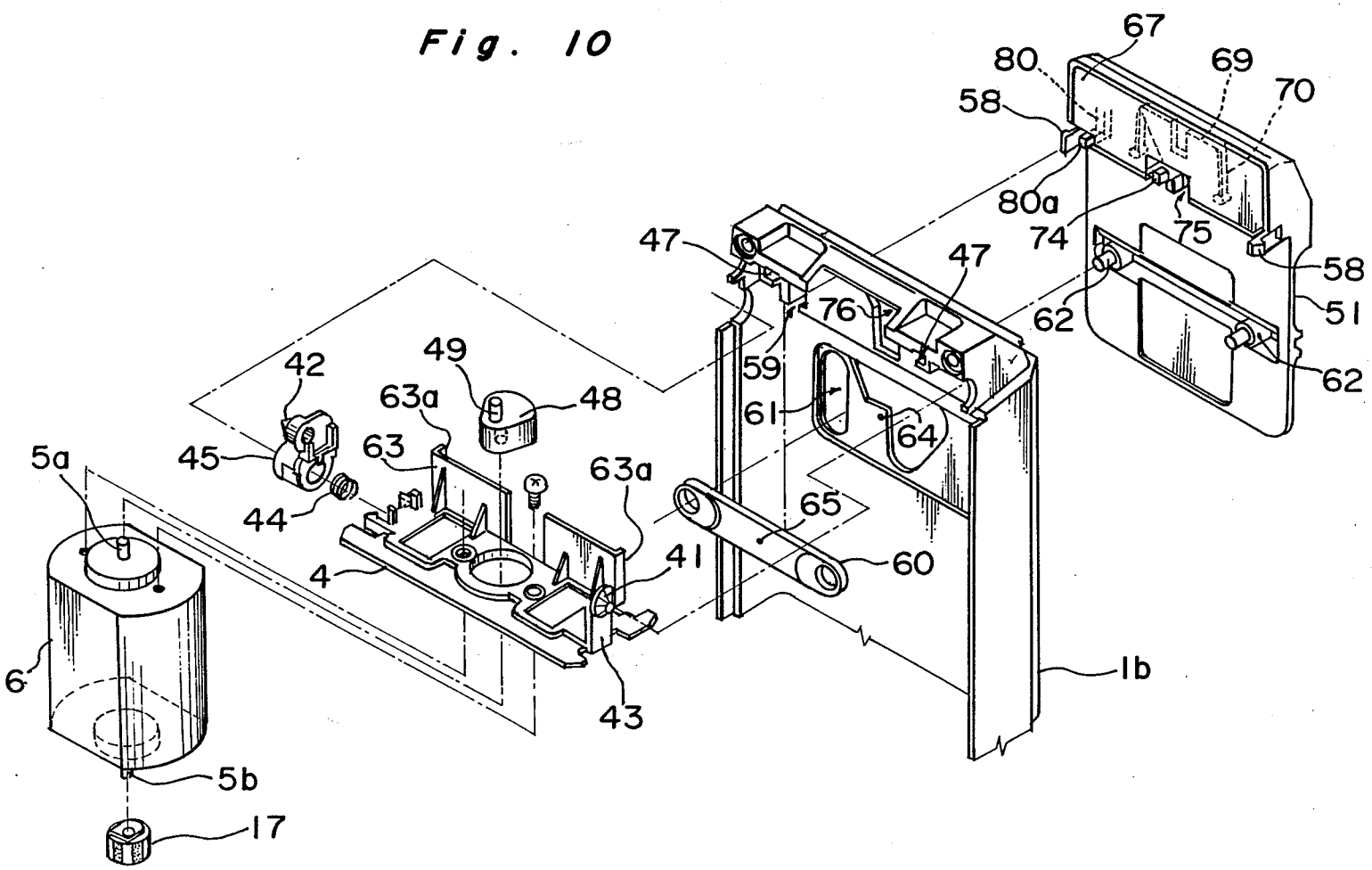
FIG. 10 is an exploded view of an upper portion of the electric shaver.
Figure 11:
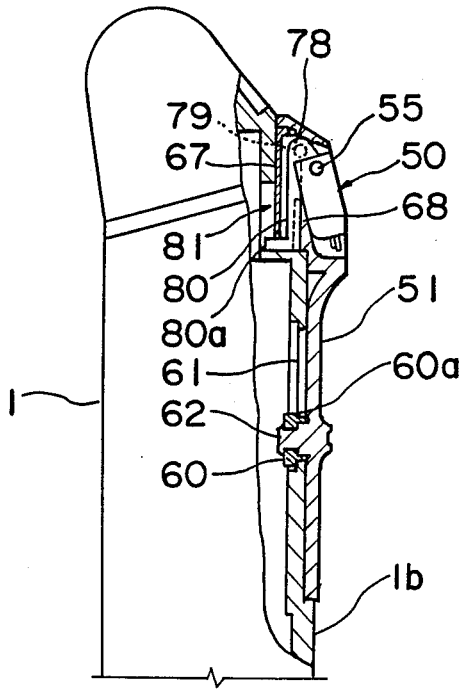
FIGS. 11 and 12 are partial side sectional views of the electric shaver showing a trimmer assembly in different positions, respectively.
Figure 12:
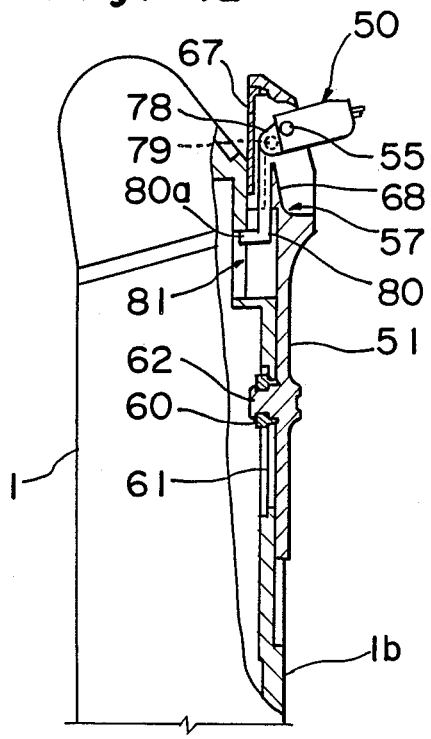

Referring particularly to FIGS. 4, 5, 7 and 10 to 13, the rear wall Cb of the casing C carries a trimmer assembly generally identified by 50 and positioned adjacent the top wall Cc of the casing C. The trimmer assembly 50 comprises a stationary clipping member 53, fixedly supported by a generally rectangular holder 52, and a movable clipping member 54 supported for reciprocate movement in a direction lengthwise thereof, or widthwise of the casing C, relative to the stationary clipping member 53, while sliding along the stationary clipping member 53. The holder 52 has its opposite end faces formed with bearing pins 55 coaxially protruding outwardly therefrom. The trimmer assembly 50 is mounted on a trimmer casing 51 with the bearing pins 55 pivotably received in respective bearing recesses 56, defined in opposite side walls of the trimmer casing 51, whereby the trimmer assembly can be selectively pivoted about the pins 55 between folded, or inoperative, and unfolded, or operative positions as will be described subsequently, it being noted, however, that, when the trimmer assembly 50 is pivoted to the unfolded or operative position as shown in FIG. 12, the trimmer assembly 50 protrudes outwardly through a rectangular opening 57 defined in a top region of a rear panel of the trimmer casing 51.

As best shown in FIGS. 5 and 10, the side walls of the trimmer casing 51 have respective hooks 58 integrally formed therewith so as to protrude in a direction close towards the rear wall Cb (or the rear casing half 1b) of the casing C. These hooks 58 are adapted to be snapped into respective slits 59 defined in the rear wall Cb so as to extend in a direction parallel to the longitudinal sense of the casing C and adjacent the respective side walls Ce and Cf, whereby the trimmer casing 51 with the trimmer assembly 50 therein can be manually moved between lifted and lowered positions with the hooks 58 guided in and along the respective slits 59 in the rear wall Cb. The trimmer casing 51 also has a pair of projections integrally formed at 62 with the casing 51 so as to protrude towards the rear wall Cb of the casing C, with projections 62 are loosely inserted through respective slots 61 in the rear wall Cb when and after the trimmer casing 51 has been fitted to the rear wall Cb with the hooks 58 snapped into the slits 59. The slots 61 are spaced a distance from each other in a direction widthwise of the casing C and have their longitudinal axes lying parallel to the longitudinal sense of the casing C. The projections 62 having passed loosely through the respective slots 61 and terminating on one side of the rear wall Cb opposite to the trimmer casing 51, that is, within the casing C, are connected together by means of a bridge strip 60 having its opposite ends formed with respective bosses 60a into which the projections 62 are inserted and fusion-bonded thereto. In this way, the trimmer casing 51 is non-detachably supported by the casing C for sliding movement between the lifted position, as shown in FIG. 12, and the lowered position, as shown in FIG. 11, along the outer surface of the rear wall Cb of the casing C.

Figure 13:
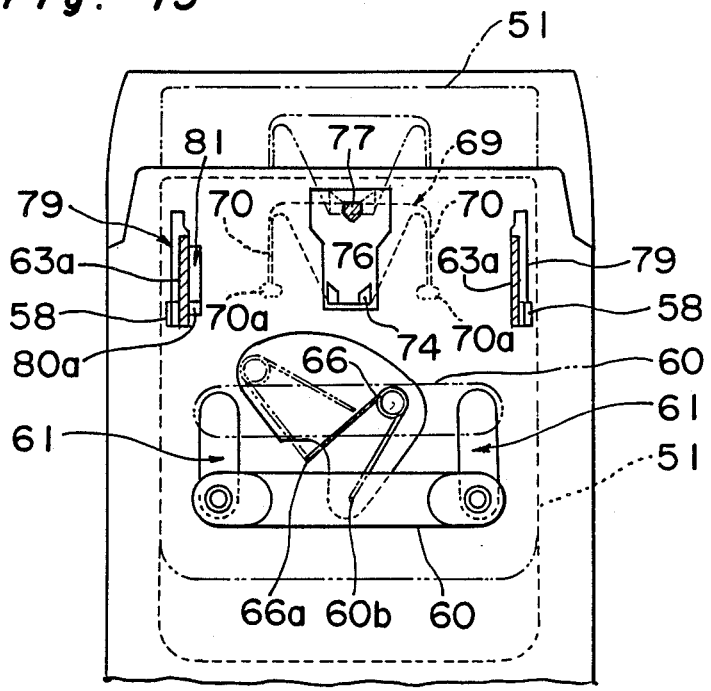
FIG. 13 is a front elevational view of a rear wall of the casing for the electric shaver showing an operating mechanism for the trimmer assembly.

The trimmer casing 51 being manually slid along the rear wall of Cb of the casing C can be snapped into any one of the lifted and lowered positions. For this purpose, the rear wall Cb of the casing C is formed with a generally sector-shaped opening in which a coiled snap-acting spring 66 is loosely accommodated, which snap-acting spring 66 has its opposite ends fixedly engaged in anchor holes 64 and 65 formed respectively in the rear wall Cb and the bridge strip 60. This snap-acting spring 66 is so positioned and so supported that, as best shown in FIG. 13, as the trimmer casing 51 is moved between the lifted and lowered positions, the position of the coiled body of the snap-acting spring 66 shifts past the dead center at which the spring 66 accumulates the maximum quantity of biasing force. More specifically, when and so long as the trimmer casing 51 is in the lowered position as shown in FIG. 11, the biasing force exerted by the snap-acting spring 66 acts to urge the trimmer casing 51 towards the lowered position as shown in FIG. 13, but when and after the trimmer casing 51 has been moved to the lifted position as shown in FIG. 12, the biasing force exerted by the snap-acting spring 66 acts to urge the trimmer casing 51 towards the lifted position as shown by the phantom line in FIG. 13.

Referring still to FIGS. 5 and 10 to 13, a cover plate 67 is fitted to an upper region of the trimmer casing 51 on one side of the trimmer assembly 50 opposite to the rectangular opening 57. A space defined in the upper region of the trimmer casing 51 between the cover plate 67 and an upright wall 68 of the trimmer casing 51, accommodates therein a generally M-shaped vibratory coupler 69, made preferably of plastics, which coupler 69 is operable to drive the movable clipping member 54 reciprocately along and relative to the stationary clipping member 53. The vibratory coupler 69 has a pair of resilient legs 70 on respective sides thereof and is supported in position between the trimmer assembly 50 and the cover plate 67 with their free ends 70a pivotably fitted in respective bearing recesses 71 defined in the upright wall 68. The vibratory coupler 69 also has an engagement recess 73 defined therein at a position generally intermediate between the resilient legs 70 for receiving therein a coupling projection 72 formed in the movable clipping member 54. Thus, the vibration of the vibratory coupler 69 in a direction widthwise of the trimmer casing 51, which is induced in a manner as will be described later, can be transmitted through the coupling projection 72 to the movable clipping member 54 to drive the latter for the actual trimming operation. For operatively coupling the vibratory coupler 79 with a drive motor 6, housed within the casing C, only when the trimmer casing 51 is shifted to the lifted position as will be detailed later, the vibratory coupler 79 further has formed therewith a forked projection 74 positioned below the engagement recess 73 and protruding perpendicular to the coupler 79 in a direction towards the rear casing Cb of the casing C. This forked projection 74 loosely extends outwardly through transverse recess 75 defined in a lower intermediate edge portion of the cover plate 67 for the purpose which will become clear from the subsequent description.

With the trimmer casing 51 fitted exteriorly to the rear wall Cb of the casing C, the forked projection 74 protruding outwardly through the transverse recess 75 in the cover plate 67 extends through an opening 7b defined in the rear wall Cb adjacent the top wall Cc and intermediately of the width of the casing C for engagement with a projection 77 formed integrally with a generally elongated oscillatory support 35 as will be described later. The oscillatory support 35 is drivingly coupled with the motor 6 in a manner as will be described later so that the oscillatory support 35 can undergo a reciprocating motion in a direction lengthwise thereof or widthwise of the casing C. Therefore, the reciprocating motion of the oscillatory support 35 is accompanied by the corresponding reciprocating motion of the vibratory coupler 69 and, hence, the movable clipping member 54. However, it is to be noted that, because of the difference in level between the projection 77 integral with the vibratory coupler 69, the engagement between the projection 77 and the forked projection 74, and, more specifically, the engagement of the projection 77 into a recess in the forked projection 74, takes place only when the trimmer casing 51 is moved to the lifted position.

The opening 76 in the rear wall Cb, through which the forked projection 74 extends, is so shaped that, when the trimmer casing 51 is in the lifted position, the forked projection 74 coupled with the oscillatory support 35 through the projection 77 can freely oscillate in the opening 76, but when the trimmer casing 51 is in the lower position, the forked projection 74 can be prevented from undergoing any arbitrary motion thereby to hold the vibratory coupler 69 in a neutral position. To hold the vibratory coupler 69 in the neutral position is advantageous in that any possible creep deformation of the resilient legs 70 which would occur when the vibratory coupler 69 is kept biased in one lateral direction during the non-use of the electric shaver can be avoided. Moreover, since the projection 77 integral with the oscillatory support 35 always assumes a neutral position in alignment with the neutral position for the forked projection 74 when and so long as the electric shaver is not in use, the engagement between the projection 77 and the forked projection 74 can advantageously readily take place upon the subsequent shift of the trimmer casing 51 from the lowered position towards the lifted position.

The trimmer assembly 50 can be pivoted from the folded position towards the unfolded position, or from the unfolded position towards the folded position, in response to the shift of the trimmer casing 51 from the lowered position towards the lifted position, or from the lifted position towards the lowered position, respectively. For this purpose, as best shown in FIGS. 5, 11 and 12, the holder 52 is formed at one end adjacent one of the pins 55 with a perforated lug 78 protruding perpendicular to the axis passing concentrically through the pins 55. A generally L-shaped operating arm 80 is pivotally connected at one end with the perforated lug 78 by means of a connecting pin 79, which may be a member either separate from the arm 80 or integral therewith, and extends downwards in a clearance between the upright wall 68 and the cover plate 67, the other end 80a of said operating arm 80 protruding into a guide slit 81 that is defined in the rear wall Cb in parallel relationship with and in continuation to the adjacent one of the slits 59 as best shown in FIG. 13. The length of the guide slit 81 is so smaller than the stroke of movement of the trimmer casing 51 that, as the trimmer casing 51 moved from the lowered position approaches the lifted position, the end 80a of the operating arm 80 can be engaged against an upper end of the guide slit 81, causing the operating arm 80 to draw the lug 78 downwards while permitting the trimmer assembly 50 to pivot from the folded position towards the unfolded position counterclockwise about the pins 55 as viewed in FIG. 12, but as the trimmer casing 51 moved form the lifted position approaches the lowered position, the end 80a of the operating arm 80 can be engaged against the opposite, lower end of the guide slit 81, causing the operating arm 80 to lift the lug 78 upwards while permitting the trimmer assembly 50 to pivot from the unfolded position back towards the folded position clockwise about the pins 55 as shown in FIG. 11.

Figure 8:
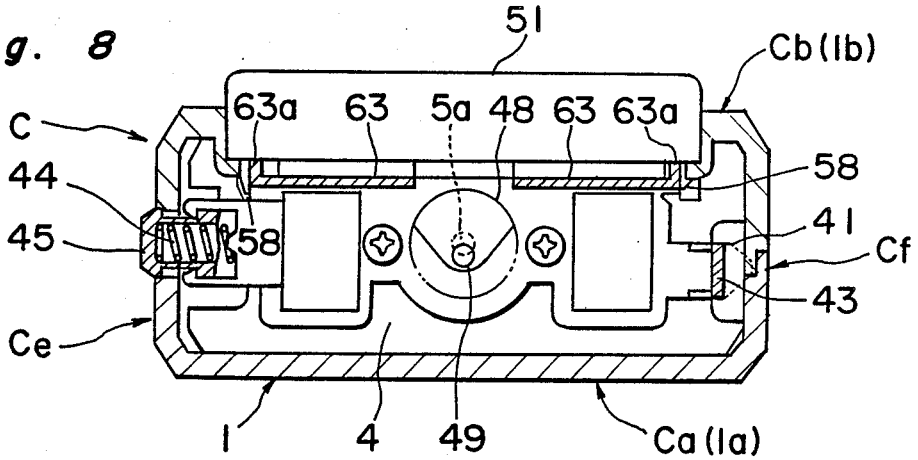
FIGS. 8 and 9 are cross-sectional views taken along the lines VIII—VIII and IX—IX in FIG. 6, respectively.
Figure 9:
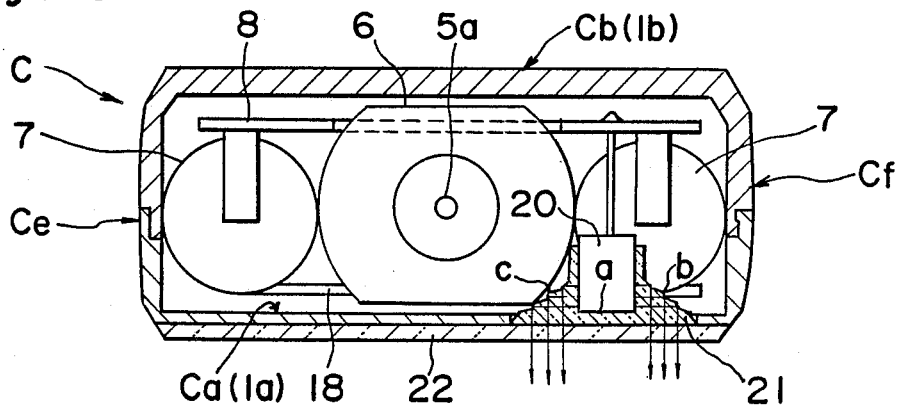

The electric motor 6 employed is of a type having its drive shaft having its opposite ends 5a and 5b exposed to the outside of the motor casing. As best shown in FIGS. 6, 7, 8 and 10, a generally rectangular mounting plate 4 is secured to one end of the motor casing by the use of a plurality of screw members so as to lie perpendicular to the drive shaft of the motor 6. The mounting plate 4 has a rectangular upright wall member 63 rigidly mounted thereof, or integrally formed therewith, so as to lie perpendicular to the mounting plate 4 and is partially cut away at an intermediate portion thereof for the entry of the forked projection 74 for the engagement with the projection 77 in the oscillatory support 35. This upright wall member 63 is integrally formed at its opposite ends with respective flanges 63a protruding therefrom so as to confront the rear wall Cb of the casing C. The flanges 63a integral with the upright wall member 63 are so spaced a preselected distance from each other that, as best shown in FIG. 8, when the mounting plate 4 with both the motor 6 and the upright wall member 63 carried thereby is housed and retained in position within the casing C, the flanges 63a can be held in position to avoid any possible inward deformation of the hooks 58, integral with the trimmer casing 51 and engaged in the respective slits 59 in the rear wall Cb, in a direction close towards each other which would otherwise result in the disengagement of the hooks 58 from the slits 59 and, hence, the separation of the hooks 58 out from the slits 59.

Figure 6:
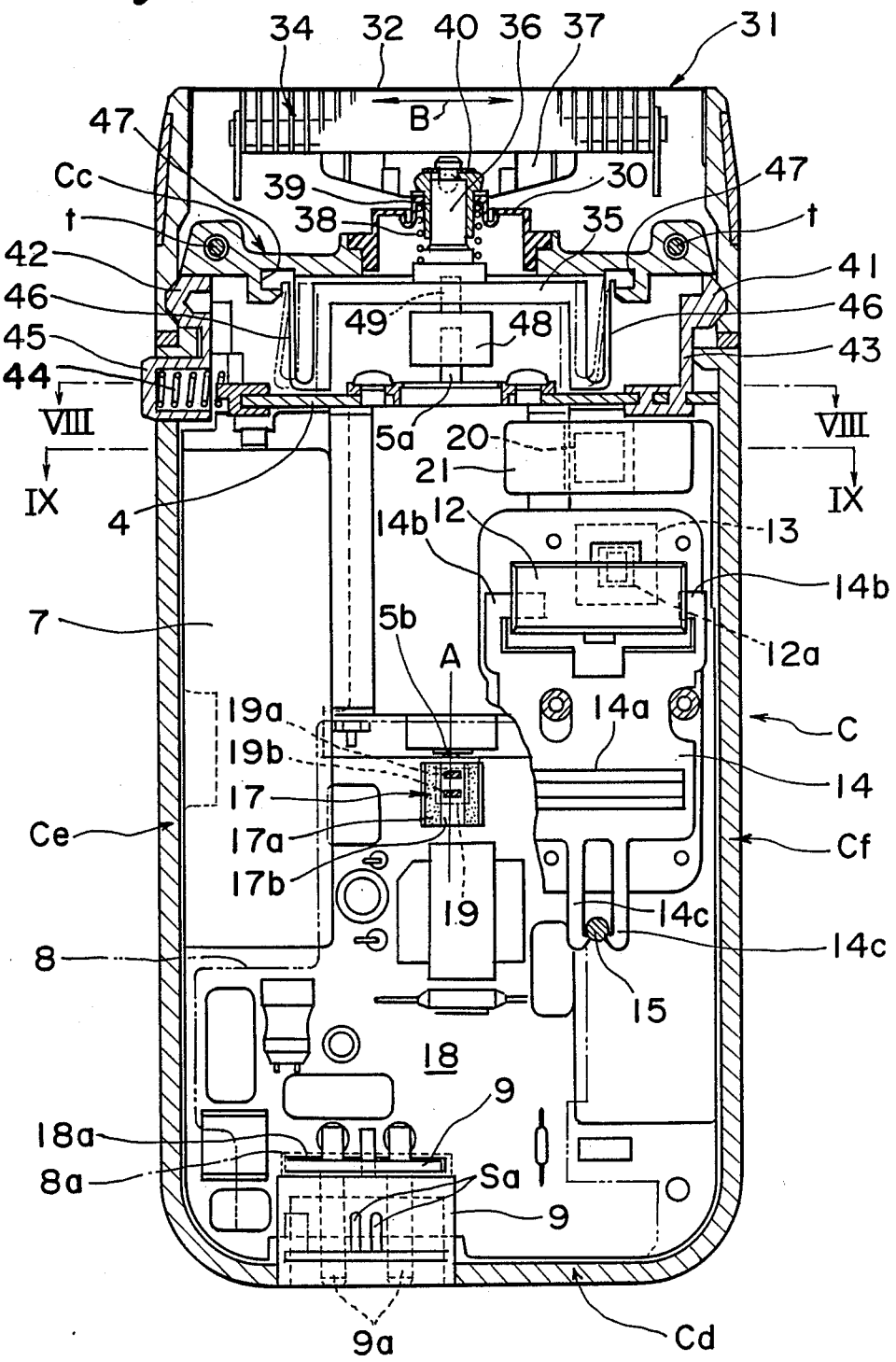
FIGS. 6 and 7 are front and side sectional views, on an enlarged scale, of the electric shaver, respectively.
Figure 7:
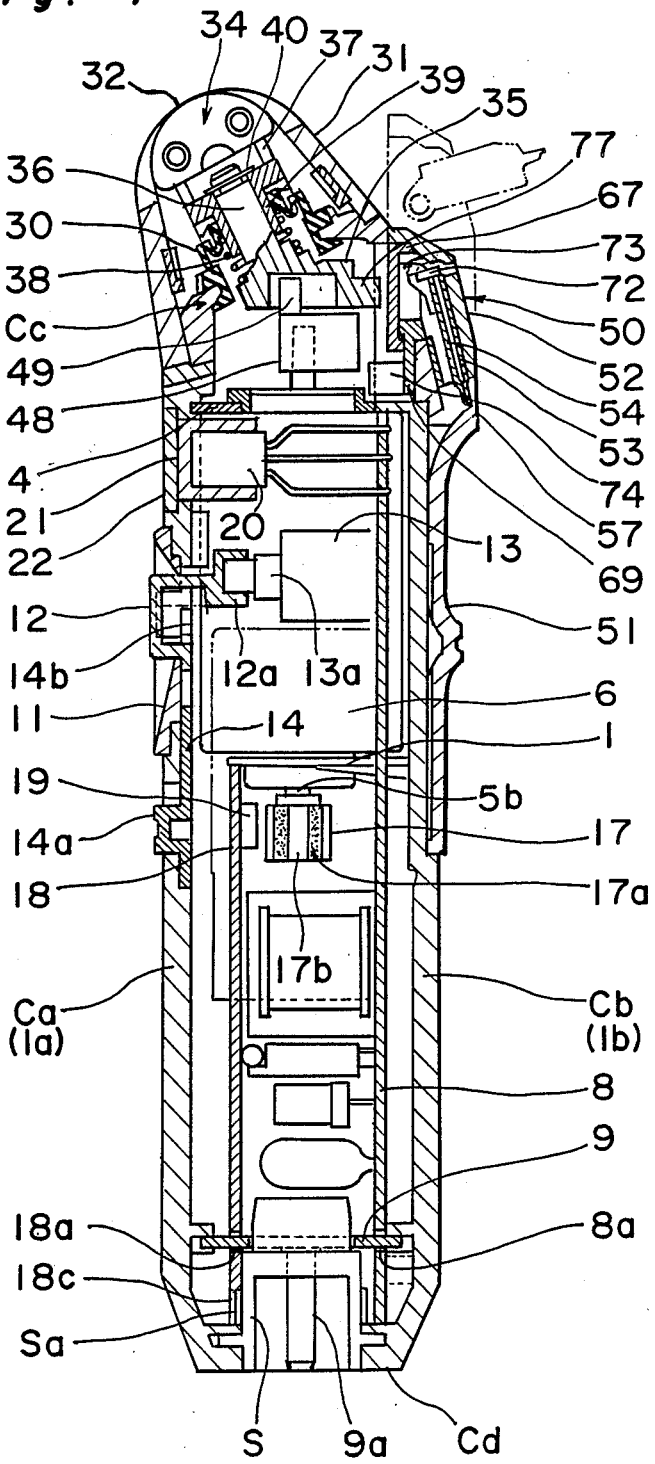

With the motor 6 housed within the casing C, the end 5a of the drive shaft of the motor 6 extends upwards, as viewed in FIGS. 6 and 7, and has a balancer block 48 rigidly mounted thereon for rotation together therewith, said balancer block 48 having an eccentric shaft 49 formed therewith so as to extend upwards therefrom in axially offset relationship with the drive shaft end 5a. The osicllatory support 35 having its opposite ends integrally formed with generally V-shaped or U-shaped resilient arms 46 is mounted on the eccentric shaft 49 while respective free ends of these resilient arms 46 are supported by associated catches 47 generally in shakehand fashion, said catches 47 being integrally formed with the top wall Cc of the casing C so as to confront towards the mounting plate 4. Thus, it is clear that, during the rotation of the drive shaft of the motor 6, the eccentric shaft 49 undergoes a revolution about the longitudinal axis of the motor drive shaft causing the oscillatory support 35 to oscillate in a direction widthwise of the casing C. The oscillatory support 35 supports any known reciprocable blade assembly 34 through a bracket 37 in a manner which will now be described with particular reference to FIGS. 6 and 7.

The oscillatory support 35 has its intermediate portion integrally formed with a support shaft 36 protruding therefrom through a rectangular opening, defined in the top wall Cc, and terminating outside the casing C. The bracket 37 is mounted on a sleeve 39 for rocking motion relative thereto about an axis perpendicular to the longitudinal axis of the sleeve 39 and is in turn mounted on the oscillatory support 35 with the support shaft 36 received inside the sleeve 39. While the length of the sleeve 39 is smaller than the support shaft 36 and the sleeve 39 is retained in position as mounted on the support shaft 36 by a washer 40, the sleeve 39 and, hence, the bracket 37, is normally upwardly biased by a coil spring 38 to allow the bracket 37 and, more particularly, the reciprocable blade assembly 34, replaceably mounted on the bracket 37, to be bounced in a direction axially of the support shaft 36. Thus, it is clear that the blade assembly 34 can not only pivot about the axis through which the bracket 37 is connected with the sleeve 39, but also rotate about the support shaft 36.

The electric shave also comprises a head casing or holder 31 supporting a finely perforated shear foil or outer blade member 32. The shear foil 32 so supported is curved to follow the curvature of the reciprocable blade assembly 34 representing a generally semi-circular cross-section so that the reciprocable blade assembly 34 can cooperate with the shear foil 32 to clip or sever bristles of hair, projecting into the interior of the head casing 31 through perforations in the shear foil 32, during the reciprocating motion of the blade assembly 34 along the inner surface of the shear foil 32.

The head casing 31 having the shear foil 32 is removably mounted atop the casing C so as to encase the blade assembly 34 therein as shown in FIGS. 6 and 7, and is retained in position atop the casing C by means of a detent mechanism of any known construction. So far shown, the detect mechanism comprises, as best shown in FIGS. 6, 8 and 10, fixed and releasable detect projections 41 and 42 cooperable respectively with detent recesses defined in inner surfaces of the opposite end walls of the head casing 31. The detent projection 41 is integrally formed with, or otherwise secured to, a resilient arm member 43 so carried by the mounting plate 4 as to permit the detent projection 41 to be engaged in the corresponding detect recess in the head casing 31. On the other hand, the releasable detent projection is rigidly mounted on, or otherwise integrally formed with, a push button member 45 that is mounted on the mounting plate 41 for movement between projected and retracted positions in a direction parallel to the longitudinal sense of the mounting plate 4 or widthwise of the casing C and is normally biased to the projected position by a spring 44. The push button member 45 in the projected position partially protrudes to the outside of the casing C for the access to a finger of the user, and by pushing this push button member 45 inwardly of the casing C against the spring 44, the detent projection 42 can disengage from the corresponding detent recess permitting the head casing 31 to be removed from the casing C.

Reference numeral 30 used in FIGS. 6 and 7 represents a rubber hood having one end mounted on the top wall Cc and the other end of the sleeve 39. This rubber hood 30 is used to completely close an annular opening delimited by the sleeve 39 and the peripheral lip region of the rectangular opening in the top wall Cc, for the purpose of avoiding any possible entry of clippings of hair bristles into the interior of the casing C.

Figure 14:
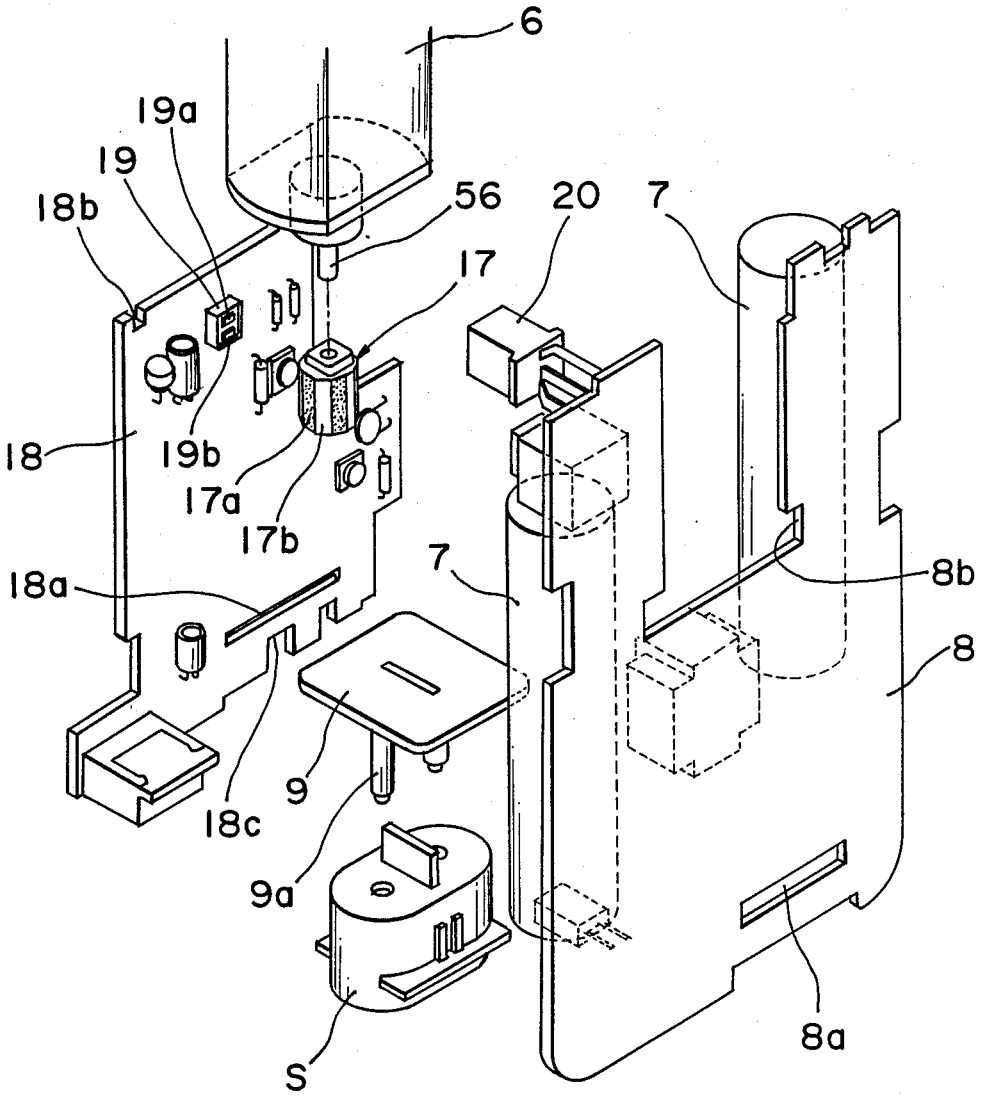
FIG. 14 is an exploded view of the printed circuit boards.

Referring to FIGS. 6, 7, 9 and 14, the casing C accommodates therein a pair of printed circuit boards 8 and 18 both carrying numerous electric and/or electronic component parts, each of said said printed circuit boards 8 and 18 being arranged in face-to-face relationship with the front and rear walls Ca and Cb. As best shown in FIG. 14, two electrically series-connected rechargeable batteries 7 are fixedly mounted on the printed circuit board 8 and positioned on respective sides of the electric motor 6 and adjacent the respective side walls Ce and Cf. By the reason which will become clear from the subsequent description, some of the electric and/or electronic cmponent parts, including a transformer and those batteries 7, which have a relatively great weight, are all mounted on and soldered to printed wirings in the printed circuit board 8 to make the printed circuit board 8 as a whole heavier than the printed circuit board 18.

The printed circuit board 8 has a three-legged, bicolor light emitting diode 20 mounted thereon with the legs soldered to printed conductors on the board 8. The position of the light emitting diode 20 is so selected as to align with the display opening in the front wall Ca immediately above the switch knob 12, which display opening is exteriorly covered by the plate 22. This diode 20 is capable of emitting green and red light one at a time, the green light being descriptive of the electric control system satisfactorily controlling the motor 6 to a proper speed, whereas the red light is descriptive of the electric control system failing to control the motor 6 to the proper speed. In other words, the emission of the green light from the diode 20 could be interpreted as representing that the total voltage charged in all of the batteries 7 is enough for the user to actually use the electric shaver, whereas that of the red light from the diode 20 could be interpreted as representing that the batteries 7 need to be charged.

The diode 20 has its light emitting region covered by a generally U-sectioned lens cap 21 made of plastics. The lens cap 21 which surrounds the light-emitting region of the diode 20 is preferably ground or regularly indented at a, b and c shown in FIG. 9 so that the rays of light emitted by the diode 20 can be diffused forwardly through the display opening above the switch knob 12.

The printed circuit board 18 has a photoelectric detector 19 rigidly mounted thereon and confronting the drive shaft end **5*b* on which a photointerrupter element 17 is rigidly mounted. The photoelectric detector 19 comprises a light emitting element 19*a* and a photoelectric cell 19*b* positioned in the vicinity of the light emitting element 19*a* in a direction parallel to the longitudinal axis of the drive shaft of the motor 6. The photointerrupter element 17 mounted on the drive shaft end 5*b* for rotation together therewith is cylindrical in shape and has its outer peripheral surface formed with a plurality of circumferentially equally spaced non-reflective surface areas 17*a* and a corresponding number of circumferentially equally spaced reflective surface areas 17*b*, said non-reflective and reflective surface areas 17*a* and 17*b* alternating in a direction circumferentially of the photointerrupter element 7**.

The photoelectric detector 19 is so designed and so positioned relative to the photointerrupter element 17 that rays of light constantly emitted by the light emitting element **19*a* can be reflected only by the reflective surface areas 17*b* of the photointerrupter element 17 back towards the photoelectric cell 19*b* during the rotation of the drive shaft of the motor 6. Thus, an output emerging from the photoelectric detector 19 represents a train of pulses, the frequency of which is a function of the speed of rotation of the electric motor 6. Since even in the present invention the control circuit shown in FIGS. 2 is employed and embodied on the printed circuit boards 8 and 18, the output signal from the photoelectric detector is converted into an analog signal which is in turn compared with a reference signal representative of an optimum speed of rotation of the motor. In this way, the electric motor 6 can be controlled to the optimum speed on a feedback control scheme. Nevertheless, the light emitting diode 20 no longer emits light when and after the total voltage remaining in the batteries 7 has fallen below a minimum voltage required for the control system to work. The emission of the red rays of light from the diode 20, which has been described as warning that the batteries are to be charged, may also be interpreted as warning that the control system would soon fail to operate because of the insufficient voltage remaining in the batteries 7**.

Although the photoelectric detector 19 may be mounted on the printed circuit board 8, instead of the printed circuit board 18, in alignment with the photointerrupter element 17 in view of the fact that the printed circuit boards 8 and 18 are positioned with the photointerrupter element 17 on the drive shaft end **5*b* intervening therebetween, the mounting of the photoelectric detector 19 on the printed circuit board 18, which is ligher than the printed circuit board 8, is preferred. The reason for this will now be discussed. The photoelectric detector 19 used in the practice of the present invention is of a type wherein the light emitting element 19*a* and the photoelectric cell 19*b* are constructed into a unitary sructure having a common substrate for both of them, and is minute in size. On the other hand, it may often happen that the user may inadvertently drop the electric shaver onto the floor or sink during use thereof, and in this case, the electric shaver may receive shocks. In general, the heavier the printed circuit board, the more the printed circuit board is considerably displaced from its original position when a given magnitude of shock is applied thereto. Accodingly, for minimizing or substantially avoiding the possible misalignment of the photoelectric detector 19 in relation to the photointerruptor element 17 which would occur when the considerable shock is applied to the electric shaver, the photoelectric detector 19 is mounted on the lighter printed circuit board 18. As a matter of fact, the heavier printed circuit board 8 is immovably fitted in the casing C and, particularly, in the rear casing half 1*b***.

The photoelectric detector 19 on the printed circuit board 18 is retained in position spaced a predetermined distance from photointerrupter element 17 or the printed circuit board 8. For this purpose, a socket S for generally concealing plug pins **9*a* for electrical connection with a commercial AC power outlet and a plug pin carrier plate 9 are utilized as a spacer. More specifically, referring to FIGS. 6, 7 and 14, the plug pins 9*a* are secured at one end to the carrier plate 9 of generally square configuration having its opposite side edges received in respective transverse slits 18*a* and 8*a* defined in the printed circuit board 18 and 8. The plug pins 9*a* so supported extend downwards into the socket S with their free ends terminating inside the socket S, which socket S is fixedly supported in the bottom wall Cd of the casing C. Specifically, the socket S is non-displaceably clamped by and sandwiched between bottom regions of the peripheral flanges of the front and rear casing halves 1*a* and 1*b*** with the opening of the socket S confronting the outside of the casing C for the access of a power supply cord (not shown) thereto.

An upper end of the printed circuit board 18 adjacent the motor 6 has a pair of recesses **18*b* (FIG. 14) formed therein for engagement with free ends of posts 1 (FIG. 7) which are integrally formed with the rear wall Cb so as to protrude towards the front wall Ca in widthwisely spaced relationship with each other. These ports 1 extend through a cut-out 8*b* in the printed circuit board 8 and are received in the respective recesses 18*b* in the printed circuit board 18, thereby minimizing any possible displacement of one or both of the printed circuit boards 8 and 18** in respective directions parallel and perpendicular to the longitudinal sense of the casing C.

A lower end of the printed circuit board 18 may have one or more, for example, two, engagement recesses **18*c* for receiving therein a corresponding number of ribs Sa (FIG. 7) formed on an outer surface of the wall of the socket S for steadily holding the printed circuit board 18. Similar engagement recesses in combination with corresponding similar ribs may also be formed on the printed circuit board 8 and the socket S as can readily be seen in FIG. 14**.

The printed circuit board 18 has a light emitting diode mounted thereon in alignment with, and so as to confront, the colored plastics piece 10 in the front wall Ca. The light emitting diode aligned with the plastics piece 10 is energized to emit light when and so long as the batteries 7 are being charged with electric power from the commercial AC power outlet.

In determining the position of the photoelectric detector 19 in relation to the photointerrupter element 17, care must be taken to avoid the possibility that the photoelectric detector 19 may be covered with hair clippings. Once this happens, the photoelectric detector system will not work properly. Therefore, in the embodiment shown in and described with reference to FIGS. 3 to 14, the photoelectric detector 19 and the photointerrupting element 17 are both housed within an area of the casing C where no hair clipping is substantially accessible. More specifically, the location where the photoelectric detector 19 and the photointerrupter element 17 is separated by the top wall Cc and the mounting plate 4 from a chamber which is defined between the top wall Cc of the casing C and the head casing 31 for accommodating hair clippings and in which the reciprocable blade assembly 34 is situated. In other words, the mounting plate 4 carrying the motor 6 concurrently serves as a shield plate for avoiding the entry of some of the hair clippings, which have entered into a space between the top wall Cc and the mounting plate 4, into the heart of the electric shaver.

Figure 15:
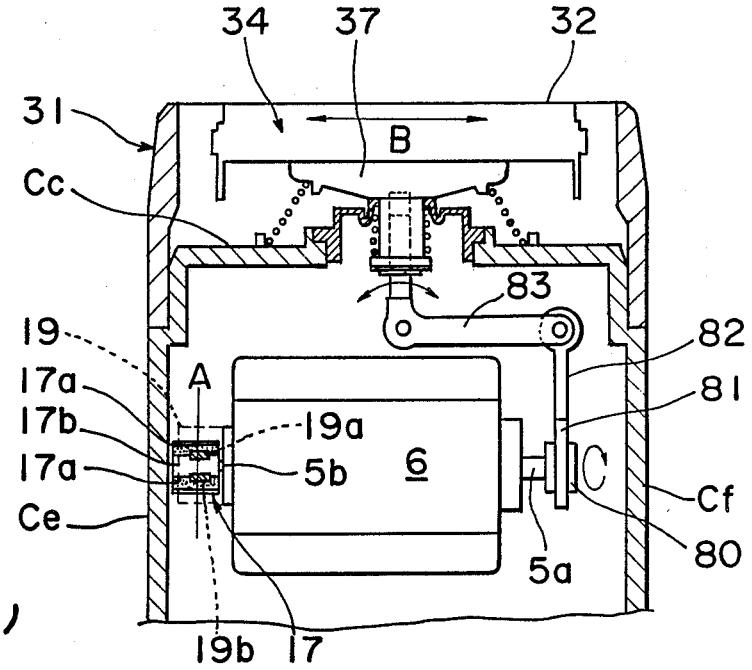
FIG. 15 is a schematic front sectional view of the electric shaver according to another embodiment of the present invention.
Figure 16A:
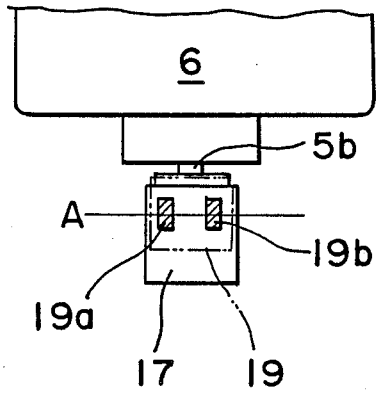
FIGS. 16(*a*) and 16(*b*) are diagrams showing the relationship between a photoelectric detector and a photointerrupter element used in the electric shaver of FIG. 15.
Figure 16B:
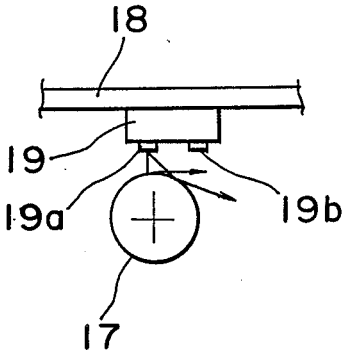

It is to be noted that, in the foregoing description, the photoelectric detector 19 has been described and shown as having the light emitting element **19*a* and the photoelectric cell 19*b* positioned in line with the drive shaft end 5*b* of the motor 6. However, the light emitting element 19*a* and the photoelectric cell 19*b* may be positioned on respective sides of the drive shaft end 5*b* substantially as shown in FIGS. 15 and 16. With reference to FIG. 15, the motor 6 is shown as rigidly mounted on the printed circuit board 8 with its drive shaft lying perpendicular to the longitudinal sense of the casing C. The drive shaft end 5*a* has an eccentric block 90 rigidly mounted thereon for rotation together therewith and operatively positioned inside a ring 91. The ring 91 has a radially outwardly extending arm 92 which is pivotally connected with a generally L-shaped rocker arm 93 having one end connected with said arm 92 and the other end drivingly coupled with the oscillatory support 37, a bent portion of said rocker arm 93** being rotatably connected to the front or rear wall of the casing C.

In the embodiment shown in FIG. 15, the photoelectric detector 19 is mounted on the printed circuit board 18 adjacent the side wall Ce of the casing C, rather than at a position substantially intermediate of the width of the casing C such as shown in FIG. 6. The photoelectric detector 19 is so positioned as to permit the imaginary line A passing through both of the elements 19*a* and 19*b* to lie perpendicular to the longitudinal axis of the drive shaft of the motor 6. Considering that the imaginary line A passing through both of the detector elements 19*a* and 19*b* lies parallel to the drive shaft of the motor 6 in the foregoing embodiment, the system would work very well even if the photoelectric detector 19 in the embodiment of FIG. 15 is so positioned as to permit the imaginary line A to assume the parallel relationship with the drive shaft of the motor 6 used in the embodiment of FIG. 15. However, to make the imaginary line A parallel to the longitudinal axis of the motor drive shaft is preferred in the practice of the present invention by the reason which will now be described with reference to FIG. 16.

During the actual use of the electric shaver with the blade assembly 34 undergoing the reciprocating motion relative to the stationary shear foil 32, the printed circuit board 18 may vibrate finely relative to the motor. Once this occurs, the direction of the fine vibration would conform to the direction of reciprocating motion of the blade assembly 34, and if the photoelectric detector 19 is so positioned as to permit the imaginary line A to lie perpendicular to the drive shaft of the motor 6 and parallel to the direction of reciprocating motion of the blade assembly 34, as shown in FIGS. 15 and 16(*a*), any slight displacement of the photoelectric detector 19 relative to the photointerrupter element 17 results in an error in detection because the light emitted from the light emitting element 19*a* and reflected by any one of the reflective surface areas 17*b* tends to travel sideways without entering the photoelectric cell 19*b* as shown in FIG. 16(*b*).

Figure 17:
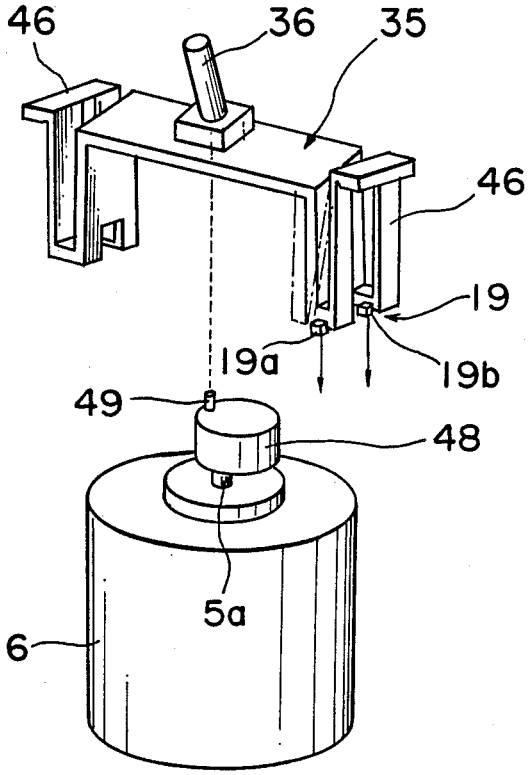
FIG. 17 is a schematic diagram showing the positioning of the photoelectric detector according to a further embodiment of the present invention.

In the foregoing embodiments, the photoelectric detector 19 has been described and shown as cooperable with the photointerrupter element 17 on the motor drive shaft for detecting the speed of rotation of the motor 6. What is essential in the practice of the present invention is to detect a parameter indicative of the frequency of oscillation, i.e., reciprocating motion, of the reciprocable blade assembly 34, and therefore, the present invention is not always limited to the detection of the speed of rotation of the motor 6. For example, in the embodiment shown in FIG. 17, the photoelectric detector 19 makes use of the light emitting element 19*a* and the photoelectric cell 19*b* which are separate from each other and are arranged within a space defined within the casing C between the mounting plate 4 and the top wall Cc of the casing while rigidly mounted on the mounting plate 4. These elements 19*a* and 19*b* in the embodiment of FIG. 17 are so positioned relative to the oscillatory support 35 that the rays of light emitted from the light emitting element 19*a* and travelling toward the photoelectric cell 19*b* can be intercepted by a lower end of one of the resilient arms 46 of the oscillatory support 35 which oscillate together with the oscillatory support 35. It will readily be seen that the output from the photoelectric detector 19 in the embodiment of FIG. 17 is indicative of the frequency of oscillation of one of the resilient arms 46 and, hence, that of the oscillatory support 35 which is a function of the speed of rotation of the motor 6.

Figure 18:
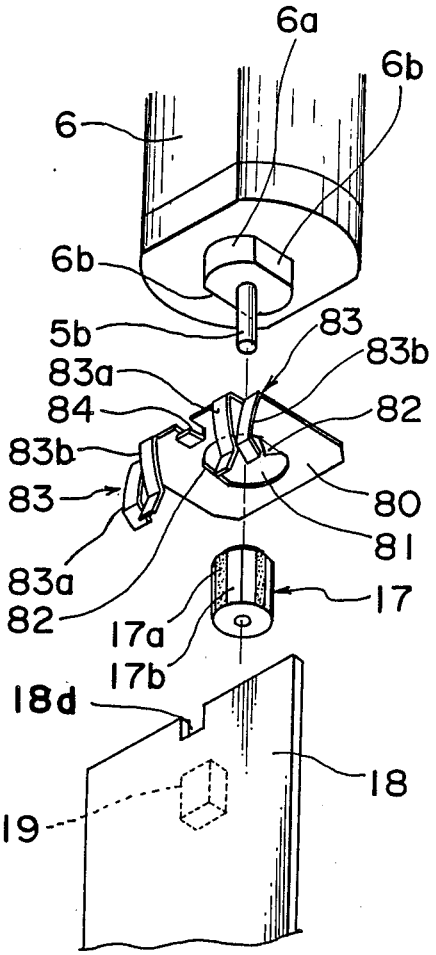
FIG. 18 is an exploded view showing a method of supporting one of the printed circuit boards to the motor according to a still further embodiment of the present invention.
Figure 19:
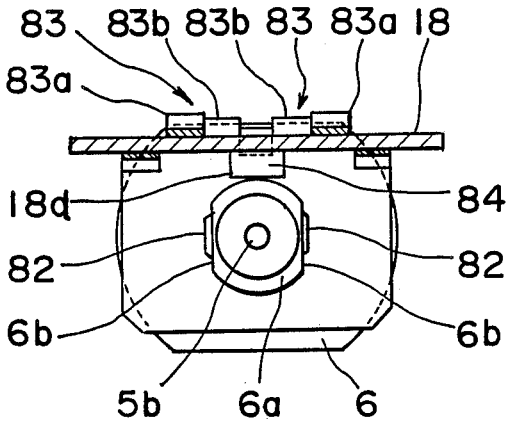
FIG. 19 is an endwise view of the motor showing the printed circuit board supported by the motor by means of a holder plate.

FIGS. 18 and 19 illustrate an alternative method of supporting the lighter printed circuit board 18 carrying the photoelectric detector 19. Where the printed circuit board 18 carrying the photoelectric detector 19 is in rigid contact with the casing C, more particularly, the front wall Ca such as in the foregoing embodiments, the printed circuit board 18 vibrates affected by the reciprocating motion of the oscillatory support 35. Since the direction and the magnitude of vibration of the printed circuit board 18 do not always match with those of the motor 6 which also vibrates affected by the reciprocating motion of the oscillatory support 35, a misalignment may occur between the photoelectric detector 19 and the interrupter element 17 rigid on the motor drive shaft. The method shown in and described with reference to FIGS. 18 and 19 is effective to subtantially minimize the above discussed problem.

Referring to FIGS. 18 and 19, the motor 6 is shown as having a cylindrical bearing projection 6*a* rigidly secured to, or integrally formed with, the motor casing adjacent the drive shaft end 5*b* and through which the drive shaft end 5*b* extends rotatably. The bearing projection 6*a* has its outer peripheral face substantially flattened at 6*b*. A generally square holder plate 80 is utilized to permit the printed circuit board 18 to be carried by the motor casing. This holder plate 80 has a mounting hole 81 defined therein in a shape complemental to the cross-sectional contour of the bearing projection 6*a*, into which hole 81 does a pair of resilient pawls 82 protrude from the peripheral lip region of the plate 80 confronting the hole 81 in opposite directions close towards each other. This holder plate 80 is mounted to the motor casing with the bearing projection 6*a* passed through the hole 81 while the resilient pawls 82 are firmly engaged to the flattened regions 6*b* of the outer peripheral face of the bearing projection 6*a*.

The holder plate 80 has a pair of clips 83 integrally formed therewith so as to project from one side edge thereof in spaced relation to each other and extending generally perpendicular to plate 80. Each of these clips 83 is comprised of a pair of resilient fingers 83*a* and 83*b* for resiliently gripping the printed circuit board 18. Thus, after the holder plate 80 has been mounted to the motor casing in the manner described above, the printed circuit board 18 can be fitted to the holder plate 80 by inserting it in between the resilient fingers 83*a* and 83*b* of the respective clips 83.

For avoiding any possible lateral displacement of the printed circuit board 18 relative to the holder plate 80, the holder plate 80 has a raised lug 84 positioned intermediately between the clips 83 for engagement into a notch 18*c* defined in the adjacent end of the printed circuit board 18.

It is to be noted that, instead of the use of of the resilient pawls 82, the holder plate 80 may be secured directly to the motor casing by the use of a plurality of set screws. In addition, the use of the holder plate 80 is not essential in the practice of the present invention, and the printed circuit board 18 may be secured directly to the motor casing by the use of a plurality of set screws.

Figure 20:
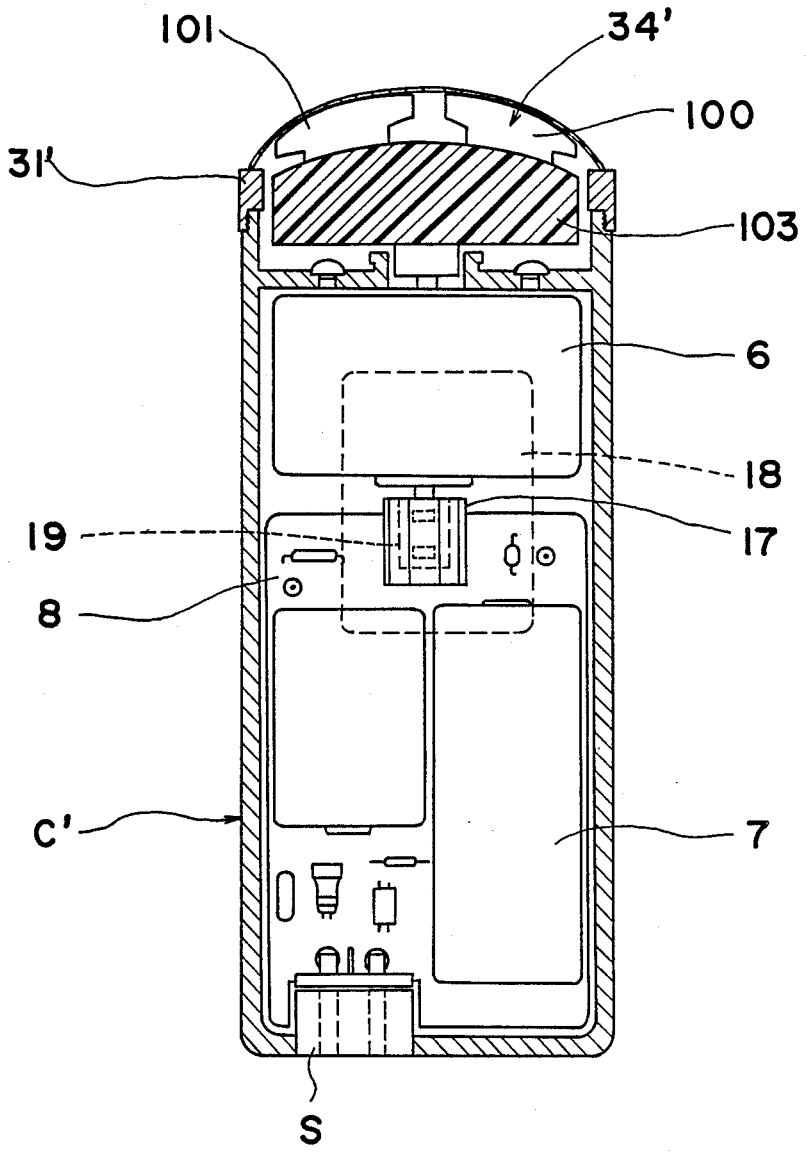
FIG. 20 is a longitudinal sectional view of a rotary electric shaver embodying the present invention.

Although the present invention has been fully described by way of example with reference to the accompanying drawings, it is to be noted here that various changes and modifications will be apparent to those skilled in the art. For example, as shown in FIG. 20, the concept of the present invention can be equally applicable to a rotary electric shaver employing a rotary blade assembly 34' mounted on one end 5*a* of the electric drive motor 6 for rotation together therewith. The blade assembly 34' used in the rotary electric shaver may be of a type comprising a plurality of blades 100 cooperable with a finely perforated stationary shear foil 101 in the head casing 31' and collapsibly mounted on a circular support or holder 103 so as to extend in radial directions with respect to the axis of rotation of the circular support 103. In general, the rotary electric shaver employs a generally cylindrical housing C'.

Therefore, unless otherwise such changes and modifications depart from the scope of the present invention, they should be construed as being included therein.

What is claimed is:

1. An electric shaver which comprises:

a shaver housing comprising a generally rectangular box-like casing and a head casing removably mounted on one end of the box-like casing;

a finely perforated stationary shear foil replaceably mounted on the head casing;

a reciprocable blade assembly positioned inside the head casing and outside the box-like casing and cooperable with the stationary shear foil to cut bristles entering the head casing through the perforations in the stationary shear foil;

an electric drive motor accommodated within the box-like casing and having a drive shaft, said drive shaft having first and second ends opposite to each other and protruding outwards from the motor in opposite directions away from each other;

means for connecting the first end of the drive shaft with the blade assembly to permit the blade assembly to undergo oscillation relative to the stationary shear foil;

a photoelectric detector comprising a light emitting element and a photoelectric cell for providing an electric output signal indicative of a parameter descriptive of the speed of rotation of the motor;

a photointerrupter element rigidly mounted on the second end of the drive shaft for rotation together therewith, said photointerrupter element having at least one reflective surface area and at least one non-reflective surface are both formed on the outer peripheral surface of the photointerrupter element in a direction circumferentially thereof; and a printed circuit board incorporating a control circuit for controlling the motor in dependence on the output signal and accommodated within the box-like casing, said photoelectric detector being located in alignment with the photointerrupter element such that rays of light emitted by the light emitting element can be reflected from the reflective surface area of the photointerrupter element back towards the photoelectric cell during the rotation of the motor.

2. The shaver as claimed in claim 1, wherein the light emitting element and the photoelectric cell are positioned close towards each other in a direction parallel to the longitudinal axis of the drive shaft.

3. The shaver as claimed in claim 1, further comprising another printed circuit board, and wherein most component parts of the control circuit are mounted on said another printed circuit board to make the latter heavier than said printed circuit board having the photoelectric detector.

4. The shaver as claimed in claim 1, further comprising a holder plate rigidly secured to the motor and having a plurality of clips for gripping the printed circuit board to permit the latter to be carried by the motor within the box-like casing.

5. An electric shaver which comprises:

a shaver housing comprising a generally rectangular box-like casing and a head casing removably mounted on one end of the box-like casing;

a finely perforated stationary shear foil replaceably mounted on the head casing;

a reciprocable blade assembly positioned inside the head casing and outside the box-like casing and cooperable with the stationary shear foil to cut bristles entering the head casing through the perforations in the stationary shear foil;

an electric drive motor accommodated within the box-like casing and having a drive shaft;

means for connecting the drive shaft with the blade assembly to permit the blade assembly to undergo oscillation relative to the stationary shear foil;

a photoelectric detector comprising a light emitting element and a photoelectric cell for providing an electric output signal indicative of a parameter descriptive of the speed of rotation of the motor, said photoelectric detector being positioned as to permit rays of light emitted from the light emitting element and travelling towards the photoelectric cell to be intercepted in a frequency generally equal to the frequency of oscillation of the blade assembly; and a printed circuit board incorporating a control circuit for controlling the motor in dependence on the output signal and accommodated within the box-like casing.

6. The shaver as claimed in claim 5, wherein said connecting means comprises an oscillatory support operatively coupled with the motor and being supported within the box-like casing with the resilient arms terminating in engagement with a wall of the box-like casing, said light emitting element and said photoelectric cell being positioned on respective sides of one of said resilient arms whereby the rays of light emitted from the light emitting element and travelling towards the photoelectric cell can be intercepted by said one of the resilient arms during the oscillation of the oscillatory support.

7. An electric shaver which comprises:

a shaver housing comprising a generally cylindrical casing and a head casing removably mounted on one end of the cylindrical casing;

a finely perforated stationary shear foil replaceably mounted on the head casing;

a rotary blade assembly positioned inside the head casing and outside the cylindrical casing and cooperable with the stationary shear foil to cut bristles entering the head casing through the perforations in the stationary shear foil;

an electric drive motor accommodated within the cylindrical casing and having a drive shaft, said drive shaft having first and second ends opposite to each other and protruding outwards from the motor in opposite directions away from each other, said rotary blade assembly being mounted on the first end of the drive shaft for rotation together therewith;

a photoelectric detector comprising a light emitting element and a photoelectric cell for providing an electric output signal indicative of a parameter descriptive of the speed of rotation of the motor;

a photointerrupter element rigidly mounted on the second end of the drive shaft for rotation together therewith, said photointerrupter element having at least one reflective surface area and at least one non-reflective surface are both formed on the outer peripheral surface of the photointerrupter element in a direction circumferentially thereof; and a printed circuit board incorporating a control circuit for controlling the motor in dependence on the output signal and accommodated within the cylindrical casing, said photoelectric detector being located in alignment with the photointerrupter element such that rays of light emitted by the light emitting element can be reflected from the reflective surface area of the photointerrupter element back towards the photoelectric cell during the rotation of the motor.

* * * * *